US006298212B1

(12) United States Patent
Kono et al.

(10) Patent No.: US 6,298,212 B1
(45) Date of Patent: Oct. 2, 2001

(54) APPARATUS PROVIDING IMPROVED IMAGE TRANSFER TO AN INTERMEDIATE TRANSFER BELT

(75) Inventors: Noriyoshi Kono; Yoshihiro Enomoto; Yukio Hayashi; Nobukazu Takahashi, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/585,409

(22) Filed: Jun. 2, 2000

(30) Foreign Application Priority Data

Sep. 14, 1999 (JP) ..... 11-260771

(51) Int. Cl.[7] ..... G03G 15/01
(52) U.S. Cl. ..... 399/302; 399/308
(58) Field of Search ..... 399/302, 308, 399/307

(56) References Cited

U.S. PATENT DOCUMENTS 5,771,432 6/1998 Nakayama ..... 399/310
6,173,148 * 1/2001 Matsuda et al. ..... 399/310

FOREIGN PATENT DOCUMENTS 49-209 (B2) 1/1974 (JP) .
62-206567 (A) 9/1987 (JP) .
2-213879 (A) 8/1990 (JP) .
8-63003 * 3/1996 (JP) .
10-260593 (A) 9/1998 (JP) .

* cited by examiner

*Primary Examiner*—Quana M. Grainger
(74) *Attorney, Agent, or Firm*—Morgan, Lewis & Bockius LLP

(57) ABSTRACT

An image forming apparatus effectively prevents scattering of a toner image transferred to an intermediate transfer belt. The image forming apparatus has an image carrier 1 on which a toner image T formed according to image data is held; an intermediate transfer belt 3 disposed facing the image carrier 1 and supported on so as to move circularly about plural rollers 2 with tension applied; a first bias transfer unit 4 for sequentially transferring a toner image T on image carrier 1 to intermediate transfer belt 3; and a second bias transfer unit 6 for batch transferring the toner image T on intermediate transfer belt 3 to a recording medium 5; and a potential holding unit 8 for holding the surface potential of the first contact member 7 at or above the charge potential of the back of intermediate transfer belt 3, and disposed to the contact member 7 first contacting the intermediate transfer belt 3 after it passes the first bias transfer unit 4.

10 Claims, 18 Drawing Sheets

FIG.10

| DISTANCE L1 (mm) FROM PRIMARY TRANSFER POSITION TO IDLER ROLLER | 30 | 60 | 110 |
|---|---|---|---|
| DURING ROLLER CONTACT | C | B | A |
| NO ROLLER CONTACT | A | A | A |

A : NO IMAGE QUALITY DEFECTS

B : SOME IMAGE QUALITY DEFECTS

C : UNACCEPTABLE IMAGE QUALITY

FIG.12

| SAMPLE NO. | GROUND RESISTANCE (Ω) | ROLL POTENTIAL (V) | DEFECTS |
|---|---|---|---|
| 1 | 0 (ground) | ≒ 0 | C |
| 2 | 70M | ≒ 0 | C |
| 3 | 98M | ≒ 0 | C |
| 4 | 470M | 250~280 | C |
| 5 | 940M | 450~600 | C |
| 6 | 1040M | 470~620 | B |
| 7 | 1140M | 650 | A |
| 8 | 1470M | 530~630 | A |
| 9 | 2000M | 650~700 | A |

A : NO IMAGE QUALITY DEFECTS

B: SOME IMAGE QUALITY DEFECTS

C: UNACCEPTABLE IMAGE QUALITY

FIG.13

| SAMPLE NO. | RATED VOLTAGE OF THE VARISTOR (V) | ROLL POTENTIAL (V) | DEFECTS |
|---|---|---|---|
| 10 | 220 | 169 | C |
| 11 | 470 | 275 | C |
| 12 | 690 | 420 | C |
| 13 | 1030 | 840 | A |
| 14 | 1250 | 950 | A |

A: NO IMAGE QUALITY DEFECTS

C: UNACCEPTABLE IMAGE QUALITY

FIG.17

| COATING LAYER | RESISTANCE (log Ω) | CURRENT (A) |
|---|---|---|
| NONE | 8.3 | 5 μ |
| ALUMITE | 8.4 | 4 μ |
| URETHANE | 10.7 | 20n |
| PET | | 4n |
| PFA | 12.0 | 1n |

APPARATUS PROVIDING IMPROVED IMAGE TRANSFER TO AN INTERMEDIATE TRANSFER BELT

BACKGROUND OF THE INVENTION

1. Field of the Invention

The present invention relates to an image forming apparatus such as a electrophotographic copier or laser printer, and relates more specifically to an improvement of an image forming apparatus for transferring to paper or other recording medium a toner image formed on an image carrier such as a photoconductive drum by way of an intervening intermediate transfer belt.

2. Description of Related Art

An image forming apparatus of the type related to the present invention typically has developing units for black (Bk), yellow (Y), magenta (M), and cyan (C) color components disposed around an image carrier such as a photoconductive drum, and a transfer drum disposed facing the image carrier. A recording medium such as paper is affixed to the transfer drum so that with each rotation of the image carrier a toner image of each color formed on the image carrier is transferred in sequence to the paper.

A problem with this type of image forming apparatus, however, is that because unfixed toner images of each color are directly transferred in layers to the paper, numerous factors, including the thickness and surface characteristics of the paper, and the properties of the system transporting the paper to the image carrier, easily affect the quality of the resulting color image formed on the paper.

An image forming apparatus using an intermediate transfer unit to resolve such problems is taught in, for example, Japanese Examined Patent Application Publication (kokoku) S49-209, and Japanese Unexamined Patent Application Publications (kokai) S62-206567 and H2-213879.

As taught in these applications, developing units for black (Bk) yellow (Y), magenta (M), and cyan (C) color components are disposed around an image carrier such as a photoconductive drum, and an intermediate transfer unit, typically having a belt shape and called an intermediate transfer belt, is disposed facing the image carrier. An unfixed toner of each color component formed on the image carrier at each rotation of the image carrier is first sequentially transferred to the intermediate transfer belt, producing a composite first bias transfer image of superimposed toner images on the intermediate transfer belt. This composite toner image is then transferred in a second bias transfer step to the paper recording medium to form the desired image on the paper.

Advantages of this type of image forming apparatus are that because a composite toner image of multiple superimposed toner images already transferred to the intermediate transfer belt is transferred to the recording medium in a single step, the above-noted unstable factors can be eliminated, and image alignment and color offset problems occurring when transferring multiple toner image layers can be effectively prevented.

A problem that is found with this type of image forming apparatus, however, is scattering of the toner image on the intermediate transfer belt after the first bias transfer step. This results in line image parts of the toner image blurring.

It should be noted that this technical problem occurring in the above-described type of image forming apparatus also occurs in so-called tandem image forming apparatuses as taught, for example, in Japanese Unexamined Patent Application Publication (kokai) H10-260593. This tandem image forming apparatus has plural parallel image formation units with an intermediate transfer belt moving circularly along the direction in which these image formation units are arranged. Images in each of the color components (typically black, cyan, magenta, and yellow) formed on each of the image formation units are sequentially transferred to the intermediate transfer belt (first bias transfer step), and the composite color image now on the intermediate transfer belt is then transferred to the paper recording medium (second bias transfer step, or batch transfer) to form a desired image on the paper.

SUMMARY OF THE INVENTION

With consideration for the above noted problems, the present invention provides an image forming apparatus capable of effectively preventing scattering of a toner image transferred to the intermediate transfer belt.

To overcome the above problems, an image forming apparatus according to a first aspect of the present invention has, as shown in FIG. 1, an image carrier 1 on which a toner image is formed according to image data and held; an intermediate transfer belt 3 disposed facing image carrier 1 and supported on so as to move circularly about plural rollers 2 with tension applied; a first bias transfer unit 4 for sequentially transferring a toner image T on image carrier 1 to intermediate transfer belt 3; and a second bias transfer unit 6 for batch transferring the toner image T on intermediate transfer belt 3 to a recording medium 5; and is characterized by a potential holding unit 8 disposed to a first contact member 7 first contacting the intermediate transfer belt 3 after it passes the first bias transfer unit 4, and holding the surface potential of the first contact member 7 at or above the charge potential of the back of intermediate transfer belt 3.

This first aspect of the invention shall not be limited to a configuration in which one image carrier 1 rotates plural times to accomplish the first bias transfer of a toner image T to the intermediate transfer belt 3, and includes configurations having plural image carriers 1. For example, four image carriers could be parallel disposed with each used for the first transfer of a toner image T formed thereon to the intermediate transfer belt 3.

The image carrier 1 can also be a drum or a belt, and toner image T formation can be accomplished using an electrophotographic, electrostatic recording, or other technique as appropriate.

Furthermore, the intermediate transfer belt 3 can be variously comprised insofar as it supported in tension on plural rollers 2, and has resistivity sufficient to electrostatically hold the toner image T.

Furthermore, insofar as the first bias transfer unit 4 is capable of forming a transfer field and transferring a toner image T formed on the image carrier 1 to the intermediate transfer belt 3, it can be, for example, a contact transfer type using a transfer roller or similar unit, or a non-contact transfer type using a corotron or similar unit.

Furthermore, the first contact member 7 is the first member that the intermediate transfer belt 3 contacts after it passes the first bias transfer unit 4, and is conceivably any of various unit other than a roller 2 for holding the intermediate transfer belt 3 in tension. It should be noted that in the configuration shown in FIG. 1, one of the plural rollers 2 is the first contact member 7.

Furthermore, the potential holding unit 8 can be comprised in many ways insofar it is disposed to the first contact member 7 and has the ability to hold the surface potential of first contact member 7 at or above the charge potential of the back of the intermediate transfer belt 3.

A specific example of potential holding unit 8 is to dispose the first contact member 7 ungrounded.

A further example of potential holding unit 8 is to use a resistance grounding unit for grounding the first contact member 7 through a high resistance resistor.

The resistance of this high resistance resistor must be sufficient to hold the surface potential of the first contact member 7 at or above the charge potential of the back of intermediate transfer belt 3.

While this high resistance resistor can be disposed in various ways, from the perspective of the ease with which it can be achieved and the compactness of the image forming apparatus it is preferably a high resistance coating formed on the surface of first contact member 7. Furthermore, this coating is preferably made from a PET (polyethylene terephthalate) resin or PFA (perfluoro alkoxy) resin. Furthermore, the potential holding unit 8 can be a biasing unit for applying a dc bias of the same polarity as the surface potential of the intermediate transfer belt 3 to the first contact member 7.

The dc bias applied by this biasing unit must be sufficiently great to hold the surface potential of the first contact member 7 at or above the charge potential of the back of intermediate transfer belt 3.

An image forming apparatus according to this first aspect of the present invention can be alternatively achieved in an image forming apparatus having an image carrier 1 on which is formed and held a toner image T based on image data; an intermediate transfer belt 3 disposed facing image carrier 1 and supported on so as to move circularly about plural rollers 2 with tension applied; a first bias transfer unit 4 for sequentially transferring a toner image T on image carrier 1 to intermediate transfer belt 3; and a second bias transfer unit 6 for batch transferring the toner image T on intermediate transfer belt 3 to a recording medium 5; and further comprising a charge elimination preventing unit disposed to a first contact member 7 first contacting the intermediate transfer belt 3 after it passes the first bias transfer unit 4, and preventing elimination of the charge on the back of intermediate transfer belt 3.

An image forming apparatus according to a second aspect of the present invention is an image forming apparatus having, as shown in FIG. 2, an image carrier 1 on which is formed and held a toner image T based on image data; an intermediate transfer belt 3 disposed facing image carrier 1 and supported on so as to move circularly about plural rollers 2 with tension applied; a first bias transfer unit 4 for sequentially transferring a toner image T on image carrier 1 to intermediate transfer belt 3; and a second bias transfer unit 6 for batch transferring the toner image T on intermediate transfer belt 3 to a recording medium 5; and is characterized by a potential holding unit 10 disposed to all contact members 9 contacting the intermediate transfer belt 3 between the first bias transfer unit 4 and the second bias transfer unit 6, and holding the surface potential of the contact members 9 at or above the charge potential of the back of intermediate transfer belt 3.

This second aspect of the invention shall also not be limited to a configuration in which one image carrier 1 rotates plural times to accomplish the first bias transfer of a toner image T to the intermediate transfer belt 3, and includes configurations having plural image carriers 1. For example, four image carriers could be parallel disposed with each used for the first bias transfer of a toner image T formed thereon to the intermediate transfer belt 3.

Furthermore, the image carrier 1, intermediate transfer belt 3, and first bias transfer unit 4 can be variously comprised as described above with reference to a first aspect of the invention.

Furthermore, the contact members 9 are all members that the intermediate transfer belt 3 contacts between the first bias transfer unit 4 and the second bias transfer unit 6, and can be any of various unit other than a roller 2 for holding the intermediate transfer belt 3 in tension. It should be noted that in the configuration shown in FIG. 2, two of the rollers 2 are contact members 9.

Furthermore, the potential holding unit 10 can be comprised in many ways insofar it is disposed to all contact members 9 and has the ability to hold the surface potential of all contact members 9 at or above the charge potential of the back of the intermediate transfer belt 3.

A specific example of potential holding unit 10 is to dispose all contact members 9 ungrounded.

A further example of potential holding unit 10 is to use a resistance grounding unit for grounding all contact members 9 through a high resistance resistor.

The resistance of this high resistance resistor must be sufficient to hold the surface potential of all contact members 9 at or above the charge potential of the back of intermediate transfer belt 3.

While this high resistance resistor can be disposed in various ways, from the perspective of the ease with which it can be achieved and the compactness of the image forming apparatus it is preferably a high resistance coating formed on the surface of all contact members 9. Furthermore, this coating is preferably made from a PET (polyethylene terephthalate) resin or PFA (perfluoro alkoxy) resin.

Furthermore, the potential holding unit 10 can be a biasing unit for applying a dc bias of the same polarity as the surface potential of the intermediate transfer belt 3 to all contact members 9.

The dc bias applied by this biasing unit must be sufficiently great to hold the surface potential of all contact members 9 at or above the charge potential of the back of intermediate transfer belt 3.

In a configuration in which there are plural contact members 9, a common biasing unit is preferably used for all plural contact members 9.

Furthermore, an image forming apparatus according to the present invention as shown in FIG. 2 can be alternatively achieved in an image forming apparatus having an image carrier 1 on which is formed and held a toner image T based on image data; an intermediate transfer belt 3 disposed facing image carrier 1 and supported on so as to move circularly about plural rollers 2 with tension applied; a first bias transfer unit 4 for sequentially transferring a toner image T on image carrier 1 to intermediate transfer belt 3; and a second bias transfer unit 6 for batch transferring the toner image T on intermediate transfer belt 3 to a recording medium 5; and further comprising a charge elimination preventing unit disposed to all contact members 9 contacted by the intermediate transfer belt 3 between the first bias transfer unit 4 and second bias transfer unit 6, and preventing elimination of the charge on the back of intermediate transfer belt 3.

The operation of the above-noted unit of the invention is described next below.

Referring to FIG. 1, a toner image T formed on image carrier 1 is first transferred to intermediate transfer belt 3 by first bias transfer unit 4. A charge with polarity opposite the toner charge polarity is then imparted according to the toner image T to the back of the intermediate transfer belt 3 to which the toner image T has been transferred.

After this first bias transfer, the intermediate transfer belt 3 and the toner image T transferred thereto move in conjunction with belt rotation to the point of contact with the first contact member 7. The surface potential of the first contact member 7 at this time is held at or above the charge potential on the back of the intermediate transfer belt 3 by potential holding unit 8. The charge on the back of intermediate transfer belt 3 will therefore not decrease at contact with the first contact member 7, electrostatic force sufficient to hold the toner image T on intermediate transfer belt 3 will be maintained, and toner can be prevented from scattering.

BRIEF DESCRIPTION OF THE DRAWINGS

Preferred embodiments of the present invention are described in detail below with reference to the accompanying drawings, wherein:

FIG. 10 is a table showing experimental results using a first example of the invention;

FIG. 12 is a table showing experimental results using a second example of the invention;

FIG. 13 is a table showing experimental results using a third example of the invention;

FIG. 17 shows the relationship between driven roller structure and resistance;

DESCRIPTION OF THE PREFERRED EMBODIMENTS

The preferred embodiments of the present invention are described below with reference to the accompanying figures.

Embodiment 1

Figure 1:
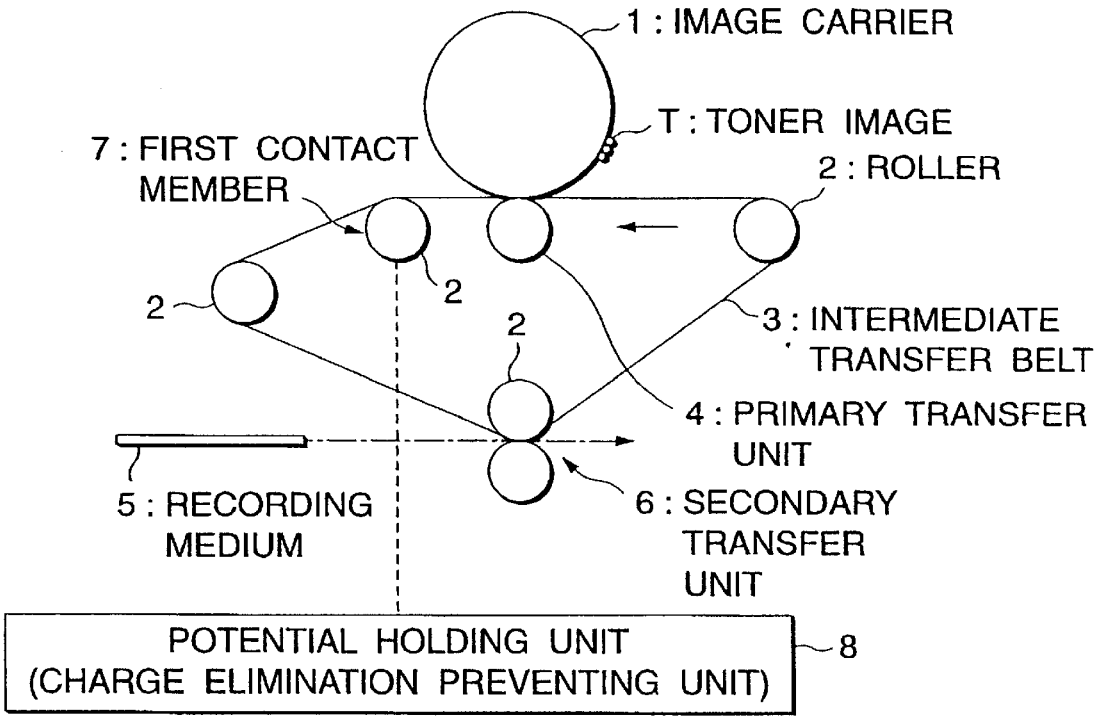
FIG. 1 is a view schematically illustrating an image forming apparatus according to a first aspect of the present invention.
Figure 2:
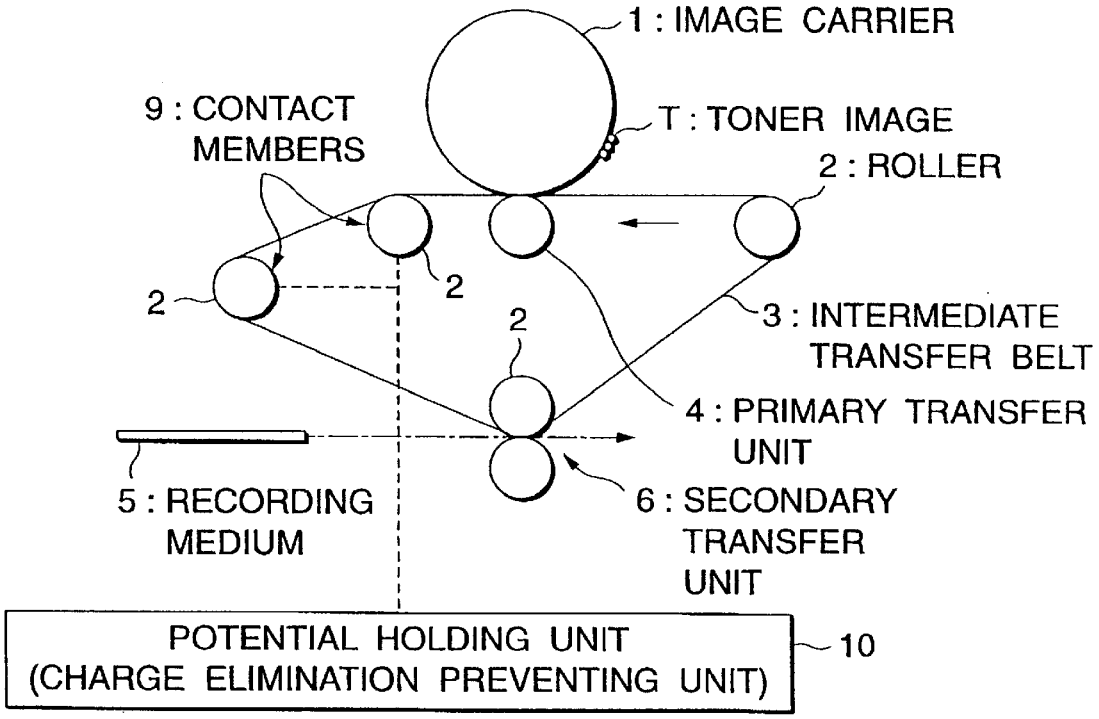
FIG. 2 is a view schematically illustrating an image forming apparatus according to a second aspect of the present invention.
Figure 3:
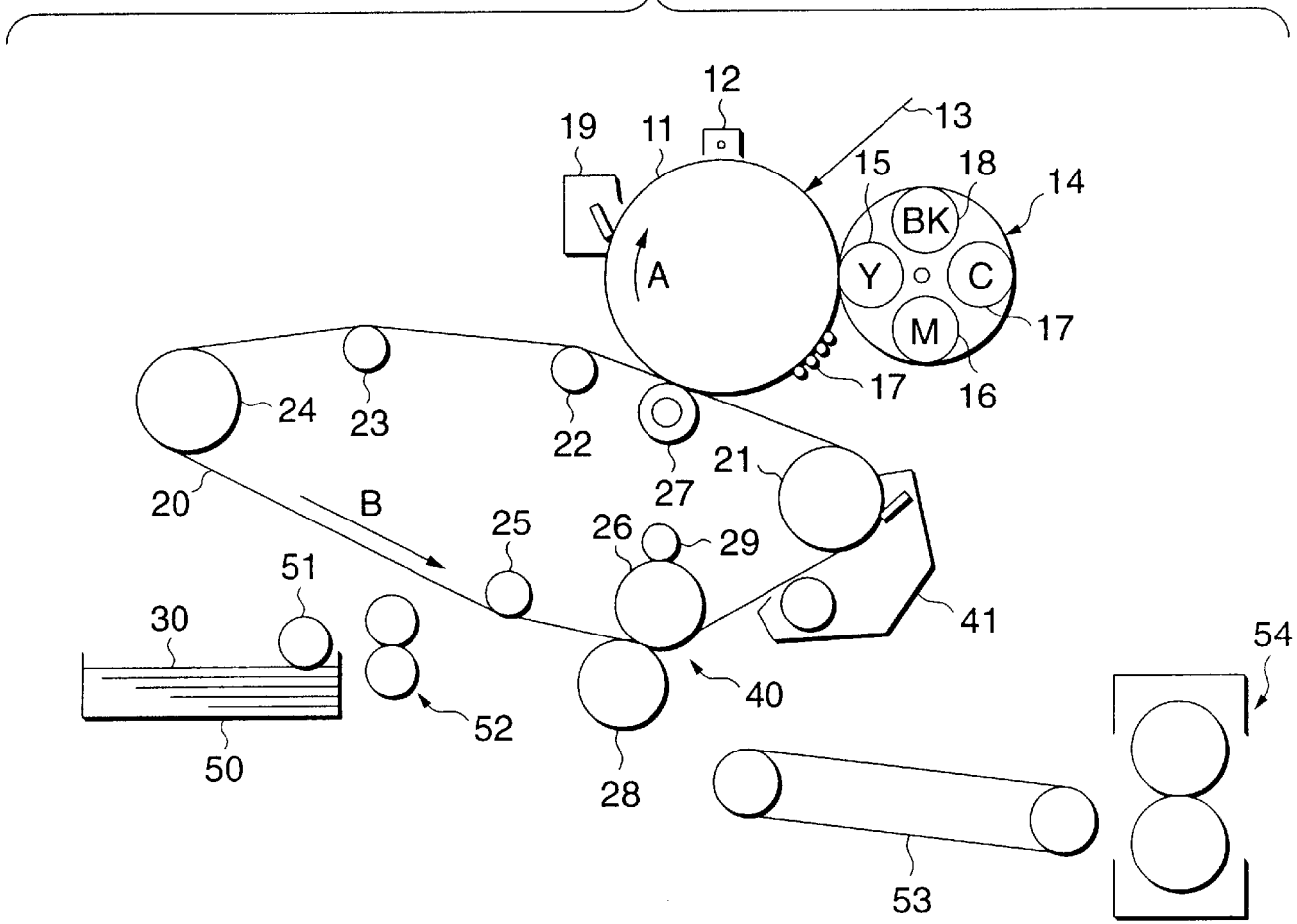
FIG. 3 is a view illustrating a first embodiment of an image forming apparatus applying the present invention.

FIG. 3 shows the typical configuration of a color image forming apparatus according to the present invention. It should be noted that this embodiment of the invention is described with reference to a color electrophotographic copier by way of example.

As shown in FIG. 3, this color image forming apparatus has a photoconductive drum 11 (latent image carrier) on which a static latent image is formed in conjunction with drum rotation in the direction of arrow A. This latent image is formed according to image data by means of a known electrophotographic process using, for example, a charger 12 and exposure device (indicated by exposure beam 13 in the figure) not shown in the figure.

A developer unit 14 having developers 15 to 18 for yellow (Y), magenta (M), cyan (C), and black (Bk), respectively, is disposed beside photoconductive drum 11 for developing the latent image on the photoconductive drum 11 using one of the developers to form a toner image T.

In this exemplary embodiment of the invention the photoconductive drum 11 is designed to hold a negative charge, and developing is accomplished with a reversal development process. The toner is therefore also a negatively charged type.

An intermediate transfer belt 20 is disposed so as to contact the surface of photoconductive drum 11. The intermediate transfer belt 20 is mounted with tension applied thereto on plural rollers 21 to 26 so that it travels circularly in the direction of arrow B.

In this exemplary embodiment, this group of rollers 21 to 26 includes driven rollers 21 and 25, a metal idler roller 22 for positioning intermediate transfer belt 20 and forming a flat first bias transfer surface, a tension roller 23 for maintaining constant tension on intermediate transfer belt 20, drive roller 24 for driving intermediate transfer belt 20, and an opposing backup roller 26 for the second bias transfer.

Figure 4:
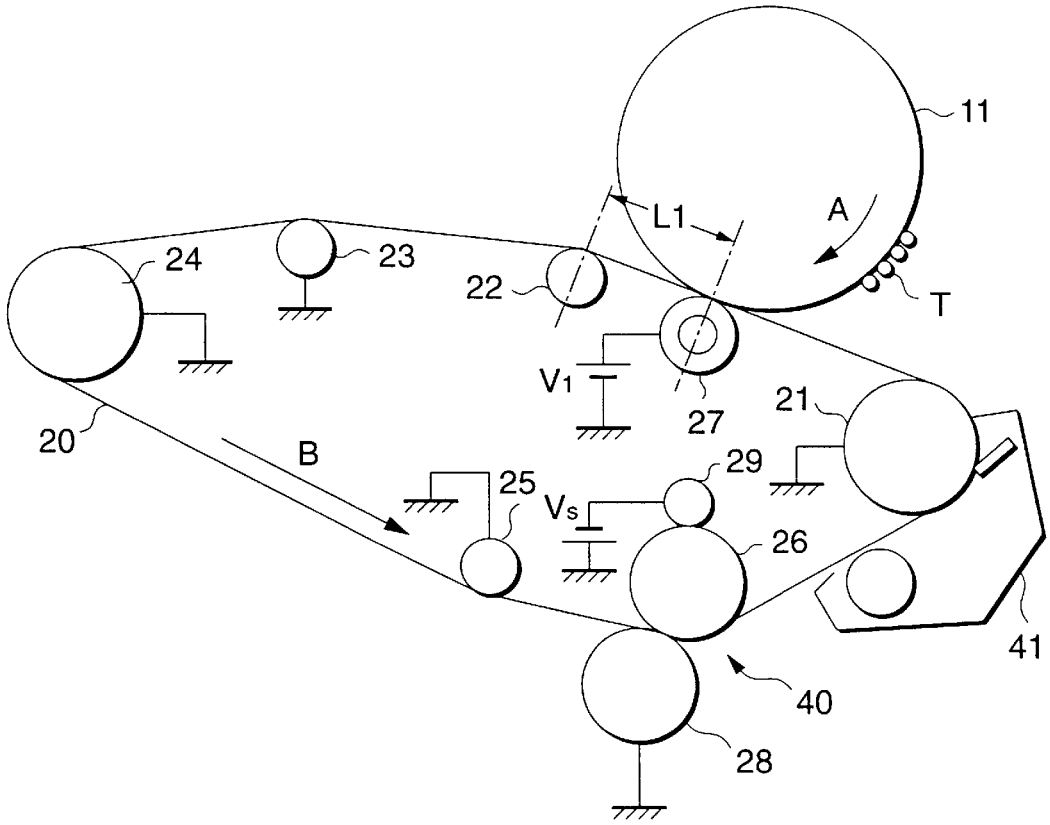
FIG. 4 is an enlarged view of the area around the intermediate transfer belt in an image forming apparatus according to the first embodiment of the present invention.

It should be further noted that, as shown in FIG. 4, driven rollers 21 and 25, tension roller 23, and drive roller 24 are grounded, while idler roller 22 is ungrounded.

Furthermore, the intermediate transfer belt 20 in this embodiment is made by blending a rubber or a resin such as polyimide, polycarbonate, polyester, polypropylene, polyethylene terephthalate, acrylic, or PVC with an antistatic agent such as carbon black in appropriate proportions to a $10^6$ to $10^{14}\Omega$cm volume resistivity and 0.1 mm thickness.

A first bias transfer device a first bias transfer roller in this embodiment) 27 is further disposed on the back side of intermediate transfer belt 20 at a position (the first bias transfer position) where the intermediate transfer belt 20 opposes photoconductive drum 11. By applying a first transfer bias Vf with polarity opposite the charge polarity of the toner, that is, positive polarity in this embodiment, to the first bias transfer roller 27 as shown in FIG. 4, the toner image T on photoconductive drum 11 is electrostatically attracted to the intermediate transfer belt 20.

It should be noted that in this embodiment of the invention the distance L1 between this first bias transfer position and the position at which the intermediate transfer belt 20 opposes the idler roller 22 is 30 mm, and the distance between the first bias transfer position and tension roller 23 is 110 mm.

A drum cleaner 19 for cleaning residual toner from the photoconductive drum 11 after the first bias transfer is also shown in FIG. 3.

A second bias transfer device 40 is further disposed at a second bias transfer position of the intermediate transfer belt 20 facing the transportation path of the paper 30 used as the recording medium. This second bias transfer device 40 consists of a second bias transfer roller 28 disposed to contact the toner carrier side of the intermediate transfer belt 20, and the opposing backup roller 26, which is disposed on the opposite (back) side of the intermediate transfer belt 20 and functions as an opposing electrode to the second bias transfer roller 28.

As also shown in FIG. 4, second bias transfer roller 28 is grounded. A second bias transfer bias Vs of the same polarity as the toner charge polarity is stably applied to backup roller 26 by way of power supply roller 29.

A belt cleaner 41 for removing residual toner from intermediate transfer belt 20 after the second transfer is disposed downstream of second bias transfer device 40.

The second bias transfer roller 28 and belt cleaner 41 are disposed retractably from the intermediate transfer belt 20 so that when forming a multicolor image, the second bias transfer roller 28 and belt cleaner 41 separate from the intermediate transfer belt 20 by the time the toner image T before the last color passes second bias transfer roller 28.

The paper transportation system in this preferred embodiment advances paper 30 from the paper tray 50 by means of feed roller 51 to registration rollers 52. The registration rollers 52 stop and position the paper 30, and then advance the paper 30 to the second bias transfer position at a predetermined timing. After the second bias transfer, the paper 30 is guided to transfer belt 53 by way of a paper transportation guide (not shown in the figure). This transfer belt 53 then advances the paper 30 to the fuser 54.

An image forming process in the image forming apparatus according to this preferred embodiment of the invention is described next. It should be noted that this image forming process typically commences when a start button (not shown in the figure) is pressed.

First, an electrostatic latent image is written to the photoconductive drum 11, and then developed by an appropriate developer.

For example, if the latent image written to the photoconductive drum 11 corresponds to image data for a yellow image, the latent image is developed by developer 15, that is, the developer containing yellow toner. A yellow toner image T is thus formed on the photoconductive drum 11.

The toner image T formed on photoconductive drum 11 is then transferred from photoconductive drum 11 to the surface of the intermediate transfer belt 20 at the first bias transfer position where the photoconductive drum 11 contacts the intermediate transfer belt 20. Any toner left on the photoconductive drum 11 after this first bias transfer step is then removed by drum cleaner 19.

If a monochrome image is to be formed, the toner image T transferred to the intermediate transfer belt 20 is immediately transferred to the paper 30 at the second bias transfer position. However, if a color image formed by overlaying multiple color toner images T is to be formed, toner image T formation on and first bias transfer of the toner image T from photoconductive drum 11 are repeated as many times as there are colors.

For example, to form a full color image requiring four color toner images, yellow, magenta, cyan, and black toner images T are formed on photoconductive drum 11 with each rotation thereof, and these toner images T are sequentially transferred to intermediate transfer belt 20. The intermediate transfer belt 20 moves circularly in the same period as the photoconductive drum 11 while holding thereon the first transferred toner image T, and the magenta, cyan, and black toner images T are transferred at each rotation of the intermediate transfer belt 20.

After the toner image T is transferred to the intermediate transfer belt 20, the intermediate transfer belt 20 travels circularly to the second bias transfer position.

At a specific timing parallel to intermediate transfer belt 20 travel, the paper 30 is supplied to the second bias transfer position whereat the second bias transfer roller 28 nips the paper 30 in conjunction with backup roller 26.

The toner image T carried on the intermediate transfer belt 20 is then electrostatically transferred to the paper 30 by action of the transfer field formed between the second bias transfer roller 28 and backup roller 26 of the second bias transfer device 40 at the second bias transfer position.

After this second transfer of the toner image T, paper 30 is transported by way of transfer belt 53 to fuser 54, and the toner image T is fixed on the paper 30. The toner carrier side of the intermediate transfer belt 20 is also cleaned of any residual toner by belt cleaner 41 after it passes the second bias transfer position.

The behavior of the primary toner image T transferred to the intermediate transfer belt 20 in the above described image forming process is described in detail next below.

When a toner image T is transferred to the intermediate transfer belt 20 in this first bias transfer process, a charge (positive in this embodiment) of polarity opposite the toner charge polarity is imparted to the back of the intermediate transfer belt 20 according to the toner charge of the toner image T. A positive charge is thus distributed according to the toner image T on the back of the intermediate transfer belt 20 in this embodiment.

The size of this charge on the back of intermediate transfer belt 20 increases each time a toner image T is transferred and overlaid to a previously transferred toner image T layer. In other words, the charge after the magenta toner image T is transferred on top of the yellow toner image T is greater than the charge after only the yellow toner image T has been transferred.

A potential is also imparted to the back of intermediate transfer belt 20 by the charge to the back of intermediate transfer belt 20, and this potential also increases as the charge increases.

After first bias transfer, the intermediate transfer belt 20 contacts idler roller 22 while carrying the transferred toner image T. Because the idler roller 22 is not grounded, the idler roller 22 is charged to substantially the same potential as the back of intermediate transfer belt 20.

The charge on the back of intermediate transfer belt 20 is thus prevented from flowing to idler roller 22, the static charge holding toner image T on intermediate transfer belt 20 is maintained, and the toner can thus be prevented from scattering.

Furthermore, because the idler roller 22 is metal in this exemplary embodiment, the surface of idler roller 22 contacting intermediate transfer belt 20 is also substantially the same potential, and local charge elimination of intermediate transfer belt 20 is also prevented.

It should be noted that while the tension roller 23 downstream of idler roller 22 is grounded, we have demonstrated that any charge elimination occurring in the back of intermediate transfer belt 20 due to tension roller 23 has substantially no effect. This is further described in detail below.

Embodiment 2

Figure 5:
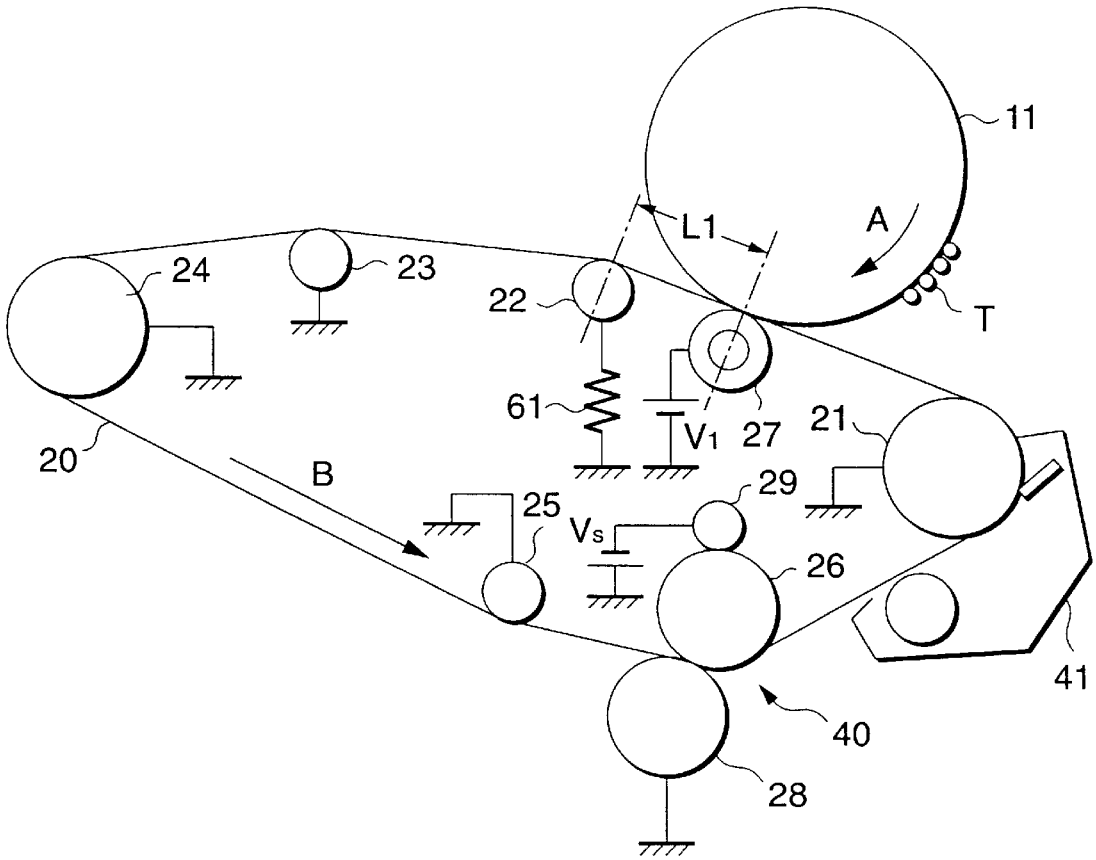
FIG. 5 is an enlarged view of the area around the intermediate transfer belt in an image forming apparatus according to a second embodiment of the present invention.

This embodiment of the invention is substantially identical to the above first embodiment, differing in that idler roller 22 is connected to ground through ground resistor 61 as shown in FIG. 5. The resistance of this ground resistor 61 is 2000 MΩ.

It should be noted that like parts in this and the first embodiment are identified by like reference numeral, and further description thereof is omitted below.

In this embodiment idler roller 22 is held charged to substantially the same potential as the back of intermediate transfer belt 20 as a result of idler roller 22 being connected to ground through an intervening ground resistor 61 having extremely high resistance.

As in the first embodiment, it is therefore possible to avoid the charge in the back of intermediate transfer belt 20 flowing to the idler roller 22, static charge sufficient to hold the toner image T on intermediate transfer belt 20 can be maintained, and toner scattering and transfer back to the photoconductive drum 11 can therefore be prevented.

Embodiment 3

Figure 6:
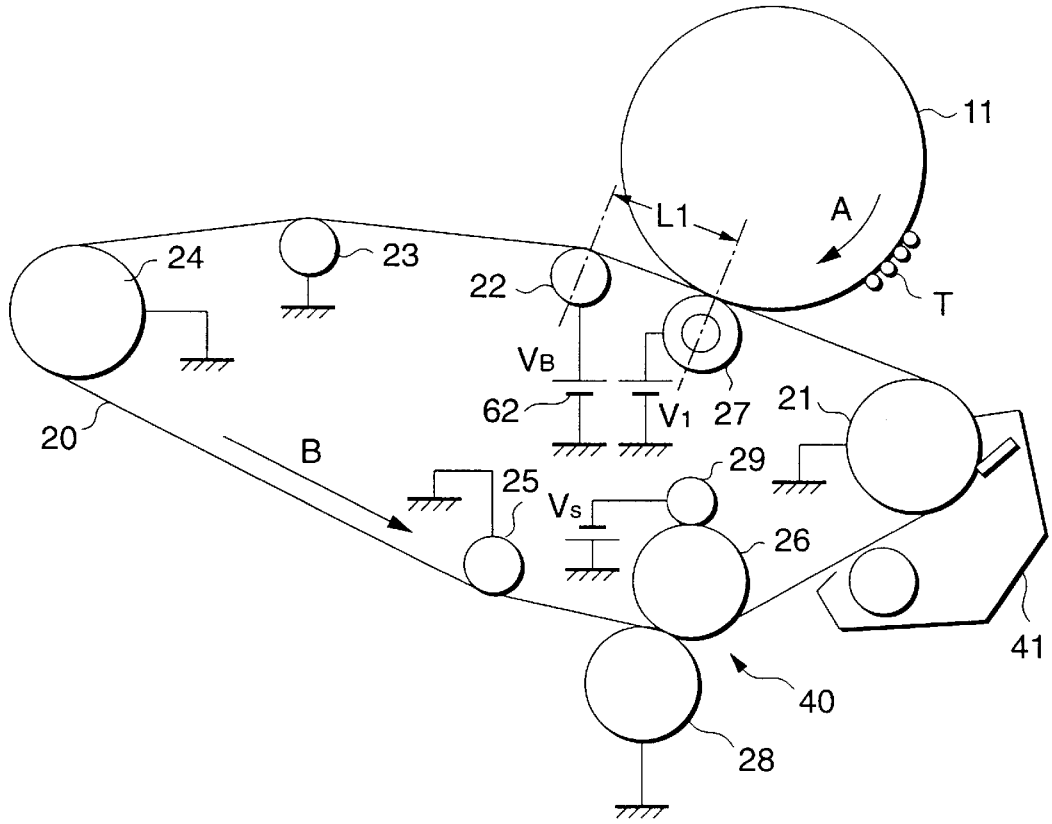
FIG. 6 is an enlarged view of the area around the intermediate transfer belt in an image forming apparatus according to a third embodiment of the present invention.

This embodiment of the invention is substantially identical to the above first embodiment, differing in that a biasing device 62 for setting the potential of idler roller 22 to greater than or equal to the potential of the back of intermediate transfer belt 20 is further provided as shown in FIG. 6. This biasing device 62 applies a 1000-V bias VB to the idler roller 22 in this embodiment.

It should be noted that like parts in this and the first embodiment are identified by like reference numeral, and further description thereof is omitted below.

The biasing device 62 of this preferred embodiment sets the potential of idler roller 22 greater than or equal to the potential of the back of intermediate transfer belt 20.

As in the first embodiment, it is therefore possible to avoid the charge in the back of intermediate transfer belt 20 flowing to the idler roller 22, static charge sufficient to hold the toner image T on intermediate transfer belt 20 can be maintained, and toner scattering and transfer back to the photoconductive drum 11 during the first bias transfer of the next color can therefore be prevented.

Embodiment 4

Figure 7:
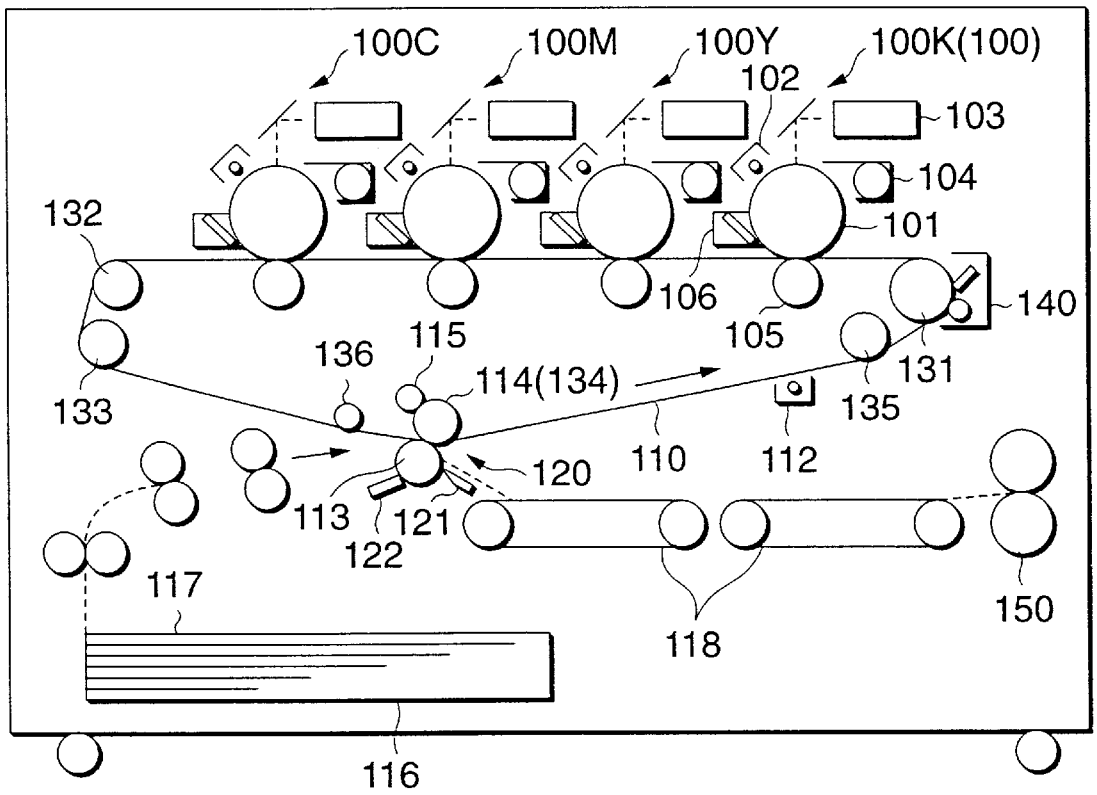
FIG. 7 is a view illustrating a fourth embodiment of an image forming apparatus applying the present invention.

FIG. 7 shows the typical configuration of a color image forming apparatus according to a fourth embodiment of the present invention.

As shown in FIG. 7, a color image forming apparatus according to this preferred embodiment has plural image formation units 100 (specifically, 100K, 100Y, 100M, and 100C) for forming toner images of each color component using, for example an electrophotographic method; an intermediate transfer belt 110 for holding sequentially transferred (first bias transfer) toner images of each color formed on the respective image formation units 100; a batch transfer unit 120 for transferring in one step (second bias transfer) the composite toner image transferred to the intermediate transfer belt 110 to paper 117 or other recording medium; a belt cleaner 140 for removing residual toner from the intermediate transfer belt 110; and a fuser 150 for fixing the batch transferred image on the paper 117.

In this preferred embodiment, the image formation units 100 for each color component (specifically, 100K, 100Y, 100M, and 100C) have the parts needed for an electrophotographic process for each color component arranged in sequence. More specifically, each image formation unit 100 has disposed around a photoconductive drum or other latent image carrier 101: a uniform charger 102 for charging the latent image carrier 101; a laser exposure unit 103 for writing an electrostatic latent image on the latent image carrier 101; a developer 104 holding an appropriate color of toner for making the latent image on the latent image carrier 101 visible; a first bias transfer roller 105 for transferring the color toner image on the latent image carrier 101 to the intermediate transfer belt 110; and a cleaner 106 for removing residual toner from the latent image carrier 101.

It should be noted that each of the latent image carriers 101 is also negatively charged in this embodiment, and developing is accomplished using a reversal development method. The toner is therefore also a negatively charged type.

Figure 8:
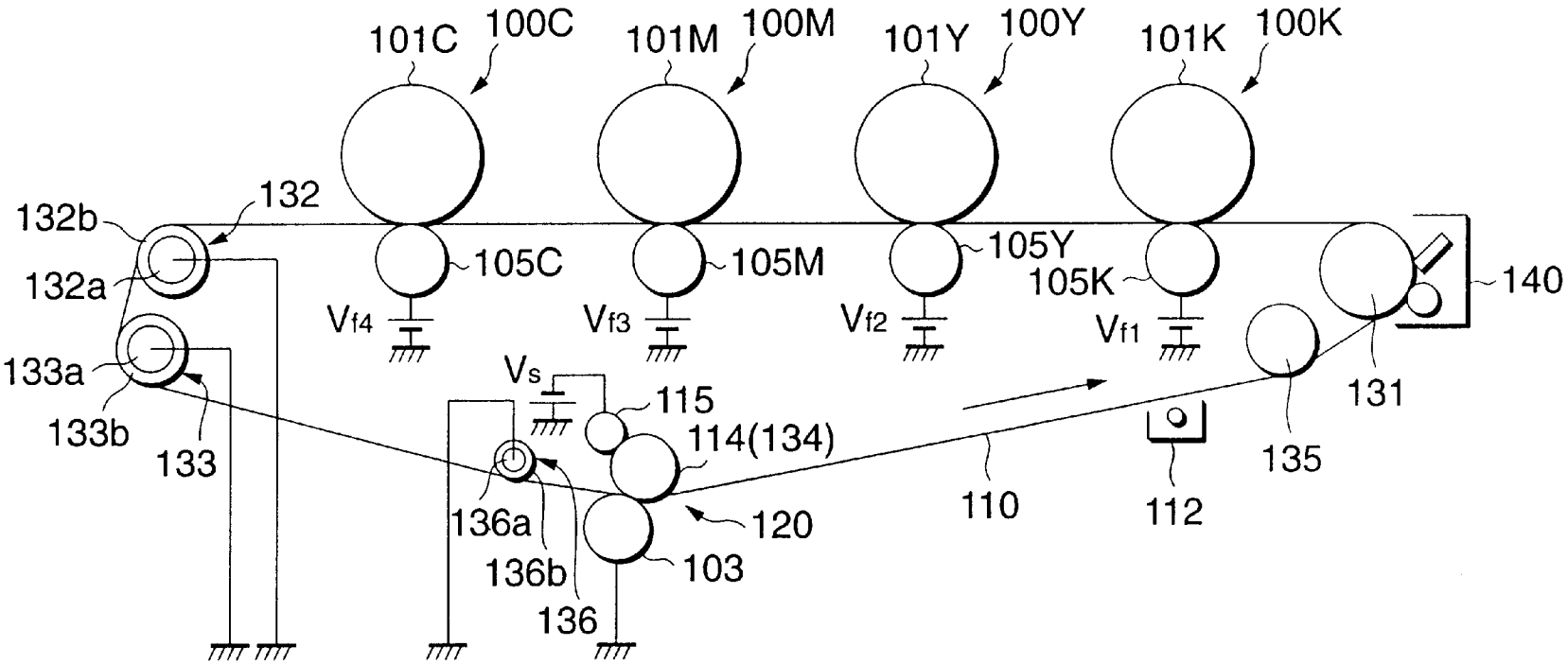
FIG. 8 is an enlarged view of the area around the intermediate transfer belt in an image forming apparatus according to the fourth embodiment of the present invention.

As shown in FIG. 8, a positive dc bias Vf1 to Vf4 is applied to the first bias transfer roller 105 (specifically, 105K, 105Y, 105M, and 105C) of each image formation unit 100.

The intermediate transfer belt 110 is mounted on plural (six in this embodiment) support rollers 131 to 136, which are used as follow. Support roller 131 is a drive roller 131 for intermediate transfer belt 110. Support rollers 132 and 135 are driven rollers. Support roller 133 is a steering roller 133 for correcting and regulating any wandering of the intermediate transfer belt 110 orthogonally to the direction of intermediate transfer belt 110 travel. This steering roller 133 is supported at one axial end thereof and can be tilted to a desired angle. Support roller 134 is a backup roller 134 for the batch transfer unit 120 as further described below. Support roller 136 is an idler roller 136 for positioning intermediate transfer belt 110 and forming a flat second bias transfer surface. As shown in FIG. 8, driven roller 132 in this embodiment has a stainless steel base 132*a* and a coating 132*b* covering the base 132*a*. In this preferred embodiment the coating 132*b* is a PFA (perfluoro alkoxy) resin, 100 μm thick with 12 logΩ resistance. The base 132*a* is to ground.

The steering roller 133 and idler roller 136 likewise have a stainless steel base 133*a* and 136*a* covered by a coating 133*b*, 136*b* with each base 133*a* and 136*a* also to ground.

In addition, drive roller 131 and driven roller 135 are stainless steel and each is connected to ground.

The intermediate transfer belt 110 is made by blending a rubber or a resin such as polyimide, polycarbonate, polyester, polypropylene, polyethylene terephthalate, acrylic, or PVC with carbon black in appropriate proportions to a $10^6$ to $10^{15}$ Ωcm volume resistivity and 0.1 mm thickness.

The batch transfer unit 120 has a second bias transfer roller 113 and backup roller 114 (which is also backup roller 134). The second bias transfer roller 113 is disposed in contact with the toner carrier side of intermediate transfer belt 110. The backup roller 114 is disposed on the opposite (back) side of the intermediate transfer belt 110, and functions as an opposing electrode to second bias transfer roller 113. A power supply roller 115 for stably applying bias of the same polarity as the toner charge polarity is disposed in contact with the backup roller 114. A separator 121 is also provided on the exit side of the nipping area of second bias transfer roller 113.

The backup roller 114 in this preferred embodiment has a metal core surrounded by a two-layer EPDM (ethylene-propylene diene monomer) coating having foam elastomer layer on the inside and a conductive exterior layer. The exterior conductive layer is a semiconducting EPDM foam rubber containing a 15 to 35 wt % dispersion of carbon black, a conductive layer thickness of 0.5 mm to 1.5 mm, and a surface resistivity controlled to the range $10^7$ to $10^{10}$ Ω/□.

The second bias transfer roller 113 has a metal core to which is bonded a core layer of foamed EPDM containing a carbon black dispersion. A 5 $\mu$m to 20 $\mu$m thick coating layer comprising a fluoroelastomer material with a carbon black dispersion is then formed over the EPDM layer with a skin layer disposed therebetween. The volume resistivity between the metal core and coating layer is from $10^4$ Ωcm to $10^6$ Ωcm; roller hardness is from 20 degrees to 45 degrees on the ASCA C hardness scale.

As shown in FIG. 8, a negative polarity batch transfer bias Vs is applied to power supply roller 115.

A urethane rubber or other type of cleaning blade 122 is further disposed to second bias transfer roller 113 as shown in FIG. 7 to remove any foreign matter from second bias transfer roller 113 and prevent soiling the back of paper 117.

A charge eliminator 112 for eliminating any residual charge on intermediate transfer belt 110 before the cleaning process is also disposed between batch transfer unit 120 and belt cleaner 140.

The paper transportation system in this preferred embodiment advances paper 117 from the paper tray 116 to the second bias transfer position at a specific timing, then to transfer belt 118 after the second bias transfer, and then to the fuser 150 by means of transfer belt 118.

An image forming process in the color image forming apparatus according to this preferred embodiment of the invention is described next. It should be noted that this image forming process typically commences when a start button (not shown in the figure) is pressed.

More specifically, when this color image forming apparatus is used as a digital color photocopier, an original set on the platen (not shown in the figure) is scanned by a color image scanner. The scanning signal is then converted by an image signal processing unit to a digital image signal, and stored temporarily in memory. Toner images of each color are then formed based on the stored four color (KYMC) digital image signals.

In other words, each of the image formation units 100 (specifically, 100K, 100Y, 100M, and 100C) is driven according to a digital image signal for each color input from the image signal processor. Then in each image formation unit 100, an electrostatic latent image is written by the laser exposure unit 103 according to the specific digital signal to the latent image carrier 101 uniformly charged by uniform charger 102.

A toner image for each color is then formed by the developer 104 storing the appropriate color developing the latent image.

When this color image forming apparatus is used as a color printer, toner images for each color can be formed based on image signals input to the image signal processor from an external source.

The toner image formed on each latent image carrier 101 is then transferred in sequence to the surface of intermediate transfer belt 110 from the latent image carrier 101 by the first bias transfer roller 105 at the first bias transfer position where the latent image carrier 101 contacts the intermediate transfer belt 110.

The toner images thus transferred to the intermediate transfer belt 110 are superimposed to each other, and carried to the second bias transfer position by circular travel of the intermediate transfer belt 110.

At a specific timing parallel to this, paper 117 is supplied to the second bias transfer position whereat the second bias transfer roller 113 nips the paper 117 in conjunction with backup roller 114.

The toner image carried on the intermediate transfer belt 110 is then electrostatically transferred to the paper 117 by action of the transfer field formed between the second bias transfer roller 113 and backup roller 114 of the batch transfer unit 120 at the second bias transfer position. After this secondary toner image transfer, paper 117 is transported by way of transfer belt 118 to fuser 150 whereby the toner image is fixed.

Any residual charge is then eliminated from the intermediate transfer belt 110 after the second bias transfer by the charge eliminator 112, and any residual toner left on the intermediate transfer belt 110 is removed by belt cleaner 140.

After the first bias transfer and before it reaches batch transfer unit 120, intermediate transfer belt 110 in this embodiment of the invention contacts driven roller 132, correction roller 133, and idler roller 136 while carrying a toner image T. As noted above, however, driven roller 132, correction roller 133, and idler roller 136 are to ground by way of the resistance of coating 132*b*, and are therefore charged to substantially the same potential as the potential of the back of intermediate transfer belt 110. The charge on the back of intermediate transfer belt 110 flowing to the driven roller 132, correction roller 133, and idler roller 136 is thus avoided, static charge sufficient to hold toner image T on intermediate transfer belt 110 is maintained, and toner is prevented from scattering.

Embodiment 5

Figure 9:
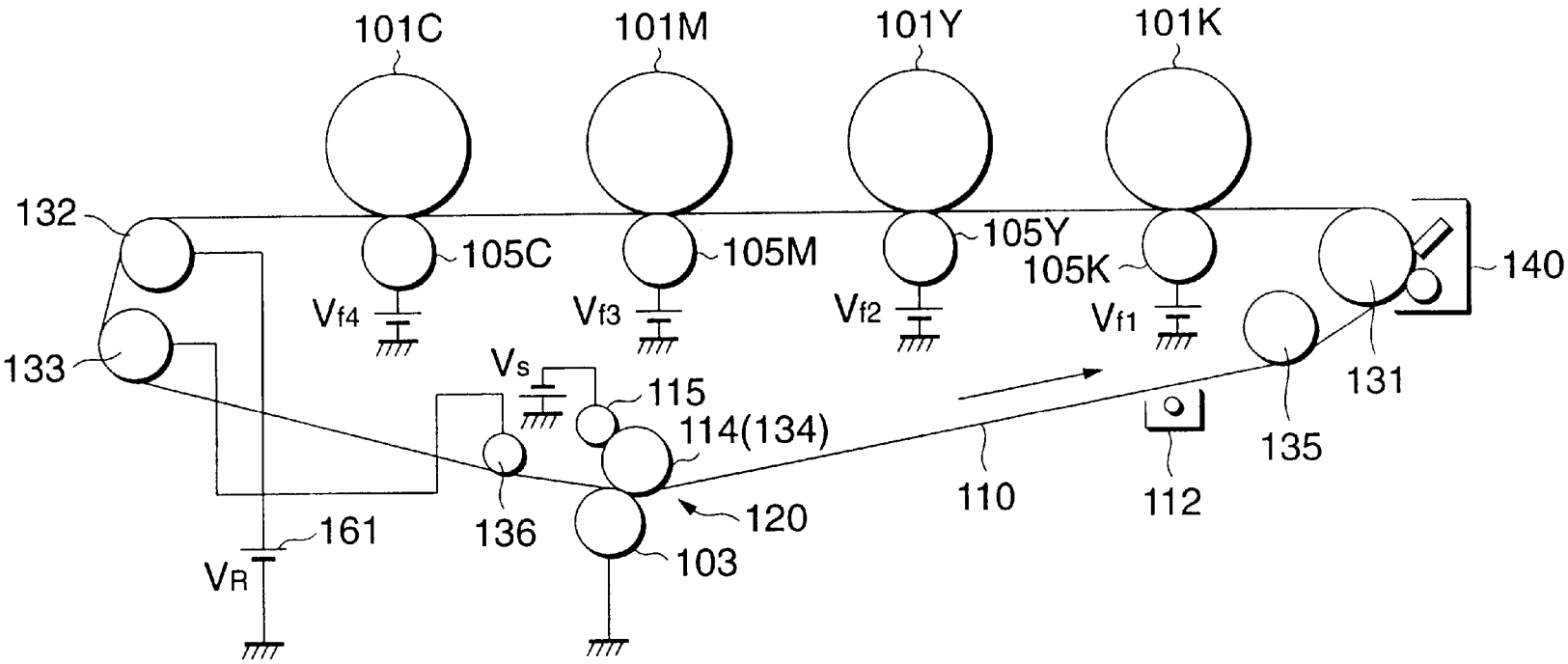
FIG. 9 is an enlarged view of the area around the intermediate transfer belt in an image forming apparatus according to a fifth embodiment of the present invention.

This embodiment of the invention is substantially identical to the above fourth embodiment, differing in that a biasing device 161 for setting the potential of driven roller 132, correction roller 133, and idler roller 136 to greater than or equal to the potential of the back of intermediate transfer belt 110 is further provided as shown in FIG. 9. This biasing device 161 applies a 1000-V bias VR in this embodiment.

It should be noted that like parts in this and the fourth embodiment are identified by like reference numeral, and further description thereof is omitted below.

The biasing device 161 of this preferred embodiment sets the potential of driven roller 132, correction roller 133, and idler roller 136 greater than or equal to the potential of the back of intermediate transfer belt 110.

As in the fourth embodiment, it is therefore possible to avoid the charge on the back of intermediate transfer belt 110 flowing to the driven roller 132, correction roller 133, and idler roller 136, static charge sufficient to hold the toner image T on intermediate transfer belt 110 can be maintained, and toner scattering can therefore be prevented.

It should be noted that the first to fifth embodiments above have been described using by way of example an image forming apparatus using a negative polarity type toner. It will also be obvious to one with ordinary skill in the related art that the invention shall not be so limited, and can be easily applied to an image forming apparatus using a positive polarity type toner.

However, the polarity of the bias applied to idler roller 22 in the image forming apparatus according to the third embodiment above, and to the driven roller 132, correction roller 133, and idler roller 136 in the above fifth embodiment, must be reversed from that described above in this case.

EXAMPLES

Example 1

We investigated the presence of image quality defects using the image forming apparatus shown in FIG. 3 and FIG. 4 while varying the distance L1 from the first bias transfer position to idler roller 22. These tests were then performed with the idler roller 22 grounded and not grounded, and the results compared.

The test parameters are shown below.

* Intermediate transfer belt: polyimide resin with carbon black dispersion
  Surface resistivity: $10^{12}$ Ω□ (at 100 V for 30 sec using an HR probe, Hirester tester, Mitsubishi Chemical)
  Volume resistivity: $10^{9}$ Ωcm (at 100 V for 30 sec using an HR probe, Hirester tester, Mitsubishi Chemical)
  Thickness: 80 μm
  Time constant: 1.0 sec or less
* First bias transfer condition: 25 μA (rated current)
* Belt speed: 220 mmlsec
* Image formed: process black (composite solid image of yellow, magenta, and cyan)

Results were evaluated by visually inspecting for transfer of the toner image T back to the photoconductive drum 11 (retransfer) when the toner image T on the intermediate transfer belt 20 once again reached the first bias transfer position after passing the idler roller 22.

The results are shown in FIG. 10.

When the idler roller 22 is grounded, image quality defects occur more easily as the distance L1 gets shorter. At L1=30 mm, image quality was unacceptable and poor. When the idler roller 22 was not grounded, however, it was confirmed that no image quality defects were observed even at L1=30

This can be explained as follows.

Figure 11A:
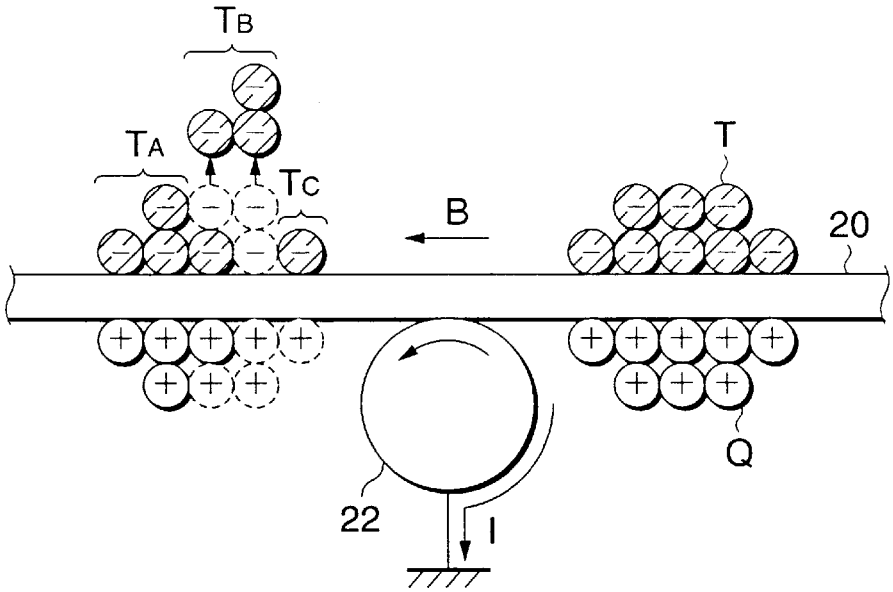
FIG. 11A shows the behavior of toner on the intermediate transfer belt when the idler roller is grounded.
Figure 11B:
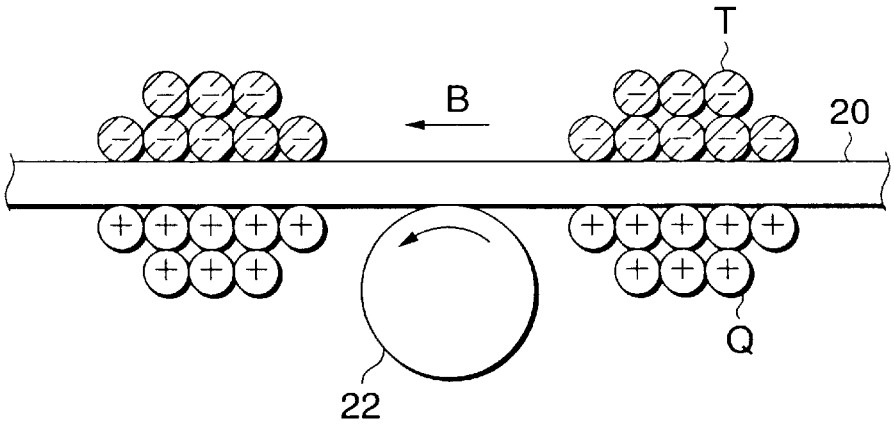
FIG. 11B shows the behavior of toner on the intermediate transfer belt when the idler roller is not grounded.

When the idler roller 22 is grounded and the intermediate transfer belt 20 passes the contact point with idler roller 22 after the first bias transfer, charge Q imparted to the back of intermediate transfer belt 20 during the first bias transfer for holding the toner image T flows to ground as current I through idler roller 22. See FIG. 11A.

The charge holding toner image T is thus rapidly eliminated at the back of intermediate transfer belt 20 after it passes the idler roller 22. Toner $T_A$ in areas that passed the idler roller 22 without the charge being eliminated from the back thus continues to be held to the intermediate transfer belt 20. On the other hand, toner $T_B$ in areas from which the charge was eliminated scatters and separates from intermediate transfer belt 20, or if it does not scatter (toner $T_c$) is transferred back to the photoconductive drum 11 at the next pass thereby because electrostatic adhesion has been significantly weakened.

However, when the idler roller 22 is not grounded, charge Q on the back of intermediate transfer belt 20 does not flow to the idler roller 22 when the intermediate transfer belt 20 passes the contact point with idler roller 22 after the first bias transfer, and charge Q is thus held on the back of intermediate transfer belt 20. In other words, the above-noted charge elimination is prevented.

That an image forming apparatus according to the present invention can prevent blurring due to toner scattering, and retransfer of toner to the photoconductive drum 11 at the next first bias transfer pass, can thus be understood.

This can be further supported by the fact that the potential of the back of intermediate transfer belt 20 immediately after first bias transfer in which process black is formed was approximately 500 V, and the potential of the ungrounded idler roller 22 was the same potential (approximately 500 V).

It was also confirmed that no image quality defects occurred at L1=110 mm even when the idler roller 22 was grounded.

This can be explained as follows.

The intermediate transfer belt 20 in this embodiment is made from a semiconducting material. That is, the intermediate transfer belt 20 has an self-discharge property. When this type of intermediate transfer belt 20 is used, any charge on the intermediate transfer belt 20 therefore gradually decreases naturally over time.

At L1=110 mm in this embodiment the charge on the back of intermediate transfer belt 20 has already decreased due to this self-discharge property, and when it contacts the idler roller 22 there is no sharp drop in the charge on the back of intermediate transfer belt 20. As a result, no image quality defects occur.

It should be noted that the tension roller 23 in the first embodiment is placed 110 mm downstream of the first bias transfer position for this very reason.

Furthermore, it should be noted that while the distance at which image quality defects no longer occur is 110 mm when the idler roller 22 is not grounded in the embodiments of the present invention described above, this distance at which no image quality defects occur varies according to the resistance and speed of the intermediate transfer belt 20, and is therefore obviously not necessarily and always 110 mm.

Example 2

We investigated the relationship between image quality defects and the resistance of ground resistor 61 with the distance L1 from the first bias transfer position to the idler roller 22 fixed at 30 mm using the image forming apparatus shown in FIG. 3 and FIG. 5. Other test conditions were as in the first example above.

The results are shown in FIG. 12.

As shown in these results, it was confirmed that as the ground resistance of the idler roller 22 rises, it also becomes more difficult for image quality defects to occur.

If we focus particularly on the relationship between the roller potential induced in idler roller 22 by ground resistor 61 and the occurrence of image quality defects, image quality defects do not occur when a ground resistance at which the roller potential becomes 500 V or greater is selected.

As described in the first example above, because the potential on the back side of the intermediate transfer belt immediately after the first bias transfer whereby process black is formed is approximately 500 V, charge elimination is prevented when a resistance whereby a potential greater than or equal to this is induced in the idler roller 22, and image quality defects can thus be prevented.

Example 3

We investigated the relationship between image quality defects and the bias VB applied to idler roller 22 by biasing device 62 with the distance L1 from the first bias transfer position to the idler roller 22 fixed at 30 mm using the image forming apparatus shown in FIG. 3 and FIG. 6. It should be noted that bias VB is applied by way of a varistor in this test. Other test conditions were as in the first example above.

The results are shown in FIG. 13.

As shown in these results, it was confirmed that as the rated voltage of the varistor rises, it also becomes more difficult for image quality defects to occur.

If we focus particularly on the relationship between the roller potential induced in idler roller 22 by bias VB and the occurrence of image quality defects, image quality defects do not occur when a varistor at which the roller potential becomes 500 V or greater is selected.

As described in the first example above, because the potential on the back side of the intermediate transfer belt immediately after the first bias transfer whereby process black is formed is approximately 500 V, charge elimination is prevented when a varistor whereby a potential greater than or equal to this is induced in the idler roller 22, and image quality defects can thus be prevented.

Example 4

We investigated the size of the voltage induced to driven roller 132, correction roller 133, and idler roller 136 in the image forming apparatus shown in FIG. 7.

Figure 14:
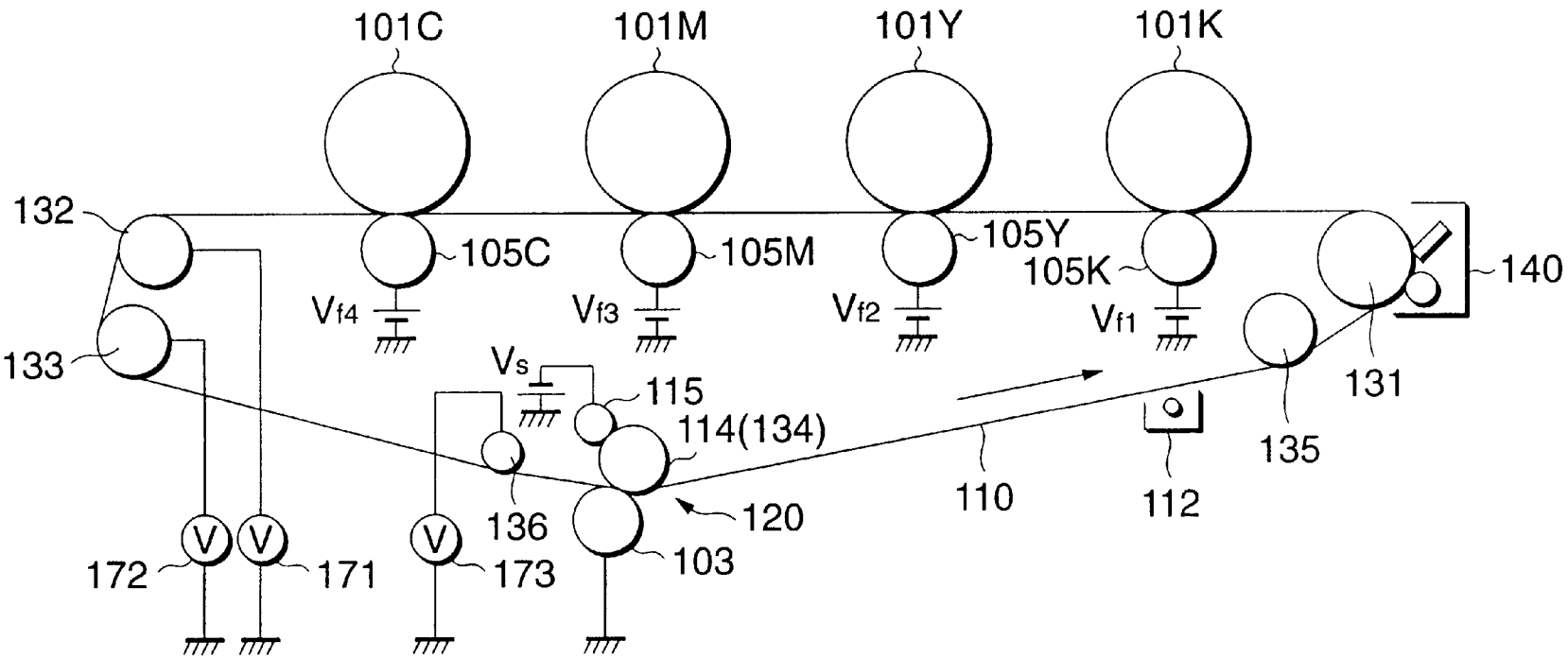
FIG. 14 shows an induced voltage measuring device for a fourth example.

As shown in FIG. 14, this test was conducted using stainless steel rollers 132, 133, and 136, and measurements were taken using a voltmeter 171 to 173 connected to each roller.

Test conditions are shown below.

* Intermediate transfer belt Volume resistivity: $10^{11}$ to $10^{13}$ Ωcm Time constant: 1.5 sec or less
* First bias transfer condition: 3 to 4 kV
* Belt speed: 264 mm/sec The distance between first bias transfer roller 105*c* and driven roller 132 was 200 mm; between driven roller 132 and correction roller 133 was 50 mm; and between correction roller 133 and idler roller 136 was 300 mm.

Figure 15:
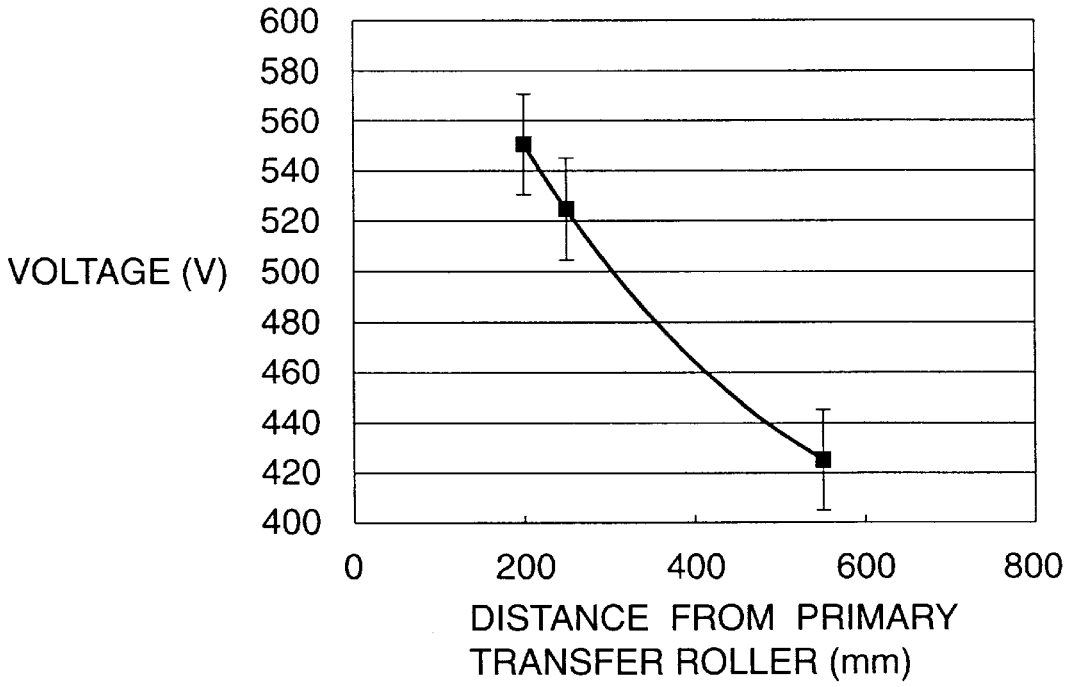
FIG. 15 is a graph showing experimental results using a fourth example of the invention.

Results are shown in FIG. 15.

It is known from the figure that while the induced voltage decreases with distance from first bias transfer roller 105*c*, there is still approximately 400 V at the idler roller 136, that is, 550 mm from the first bias transfer roller 105*c*.

This because the resistance and time constant of the intermediate transfer belt 110 used in this example are greater than the intermediate transfer belt 20 used in example 1, that is, because the self-discharge of intermediate transfer belt 110 is lower than that of intermediate transfer belt 20. That the intermediate transfer belt 110 in this example travels faster than the intermediate transfer belt 20 in the first example is another factor.

Moreover, it is known that there is substantially no change in the voltage induced in the driven roller 132 and correction roller 133 due to the proximity therebetween.

It will thus be understood that with the image forming apparatus shown in FIG. 7, it is necessary to provide a potential holding unit for the correction roller 133 and idler roller 136 as well as for driven roller 132.

Example 5

Figure 16:
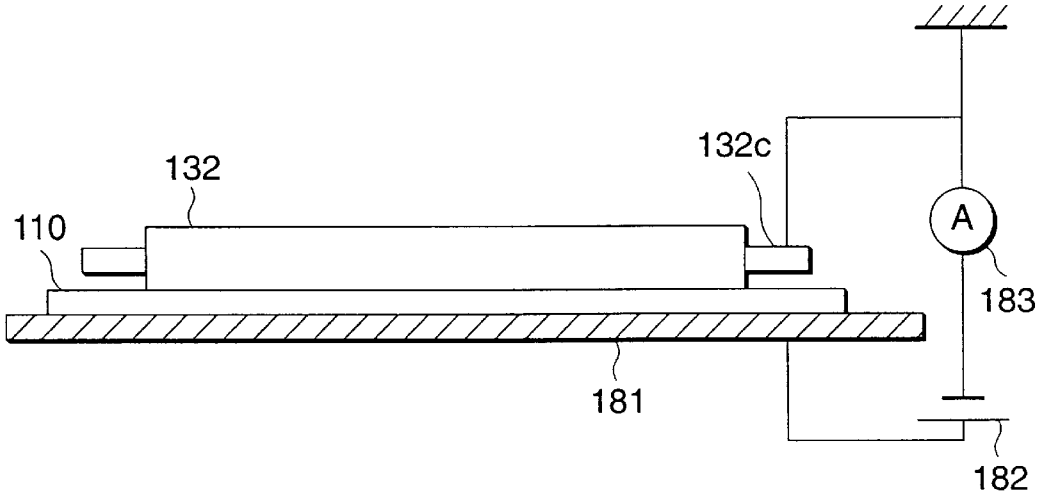
FIG. 16 shows a typical resistance measuring device used in a fifth example of the invention.

We conducted tests using the test apparatus shown in FIG. 16 to investigate what materials are best for the driven roller 132, correction roller 133, and idler roller 136 in the image forming apparatus shown in FIG. 7 and FIG. 8.

The test apparatus shown in FIG. 16 has a sheet metal 181 base, dc power source 182, and ammeter 183. The intermediate transfer belt 110 and driven roller 132 are placed on sheet metal 181, and resistance was calculated from the amount of current when a dc voltage is applied between shaft 132*c* of driven roller 132 and the sheet metal 181.

It should be noted that the driven rollers 132 used in this test were a stainless steel base 132*a* with no coating 132*b*; a stainless steel base 132*a* with an alumite layer as the coating 132*b*; a stainless steel base 132*a* with a PET layer as the coating 132*b*; and a stainless steel base 132*a* with a PFA layer as the coating 132*b*.

Results are shown in FIG. 17.

We next investigated toner image scattering with a driven roller 132 incorporated to the image forming apparatus shown in FIG. 7 and FIG. 8.

Figure 18:
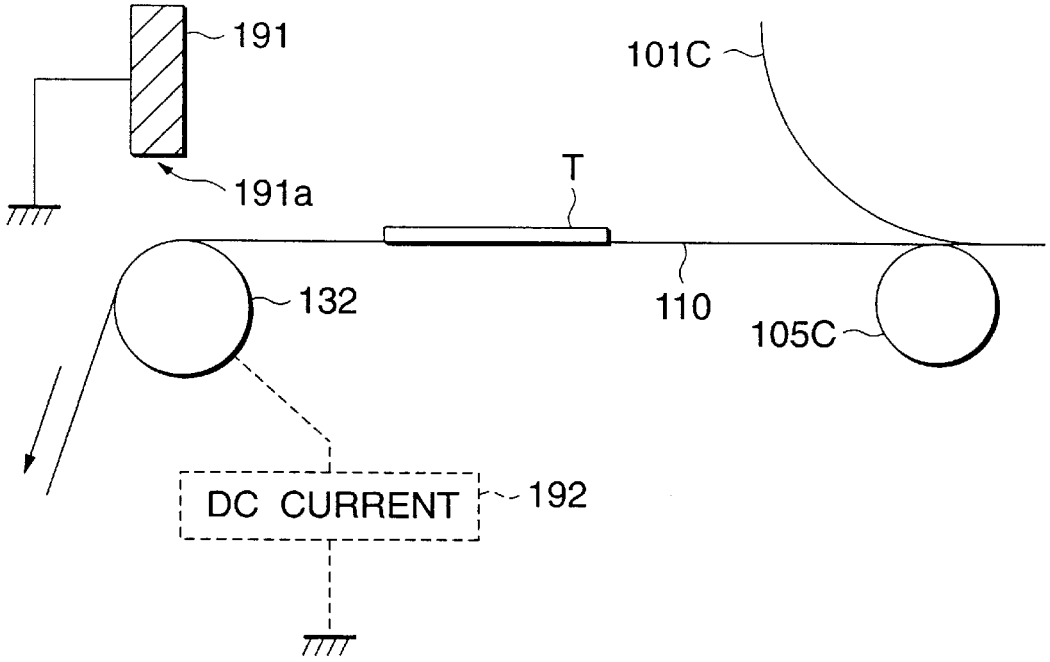
FIG. 18 shows a typical device for evaluating toner scatter used in fifth and sixth examples of the invention.

This was evaluated by disposing grounded sheet metal 191 with a 5 mm gap at a position facing driven roller 132 as shown in FIG. 18. The concentration of toner that scattered and adhered to opposing face 191*a* of sheet metal 191 when the toner image T on intermediate transfer belt 110 passed the above-noted opposite position was then measured.

Figure 19:
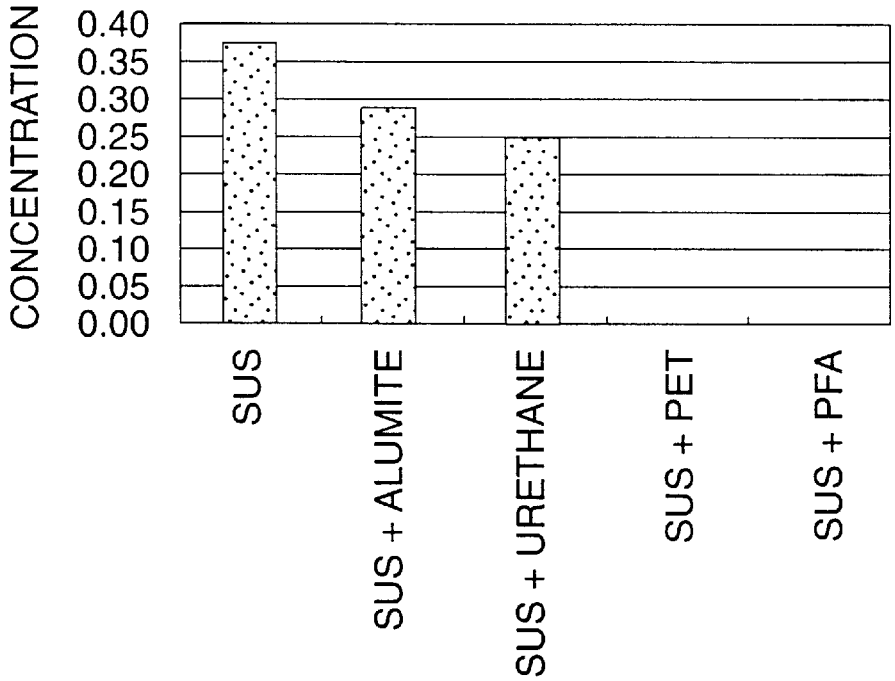
FIG. 19 is a graph showing experimental results using the fifth example of the invention.

Results are shown in FIG. 19.

These results show that toner scatter can be prevented when a PET layer and PFA layer is used for coating 132*b*.

It should be noted that our tests also demonstrated that toner scatter will not occur near the rollers when there is a slope in the coating resistance from the upstream to the downstream side, that is, when the coating 132*b*, 133*b*, and 136*b* of driven roller 132, correction roller 133, and idler roller 136 is made from PFA, PET, and urethane, respectively. This is because the voltage induced to the back of intermediate transfer belt 110 reduces gradually with distance from the first bias transfer roller 105*c* as described in the fourth example above.

Example 6

We also used the test apparatus shown in FIG. 18 to determine the bias to be applied to driven roller 132 in the image forming apparatus shown in FIG. 7 and FIG. 9.

The driven roller 132 used in this test was also stainless steel. A dc power source 192 for applying positive and negative voltages was also connected to the driven roller 132. The concentration of toner scattering and adhering to opposing face 191*a* of sheet metal 191 was measured by varying the applied voltage.

Figure 20:
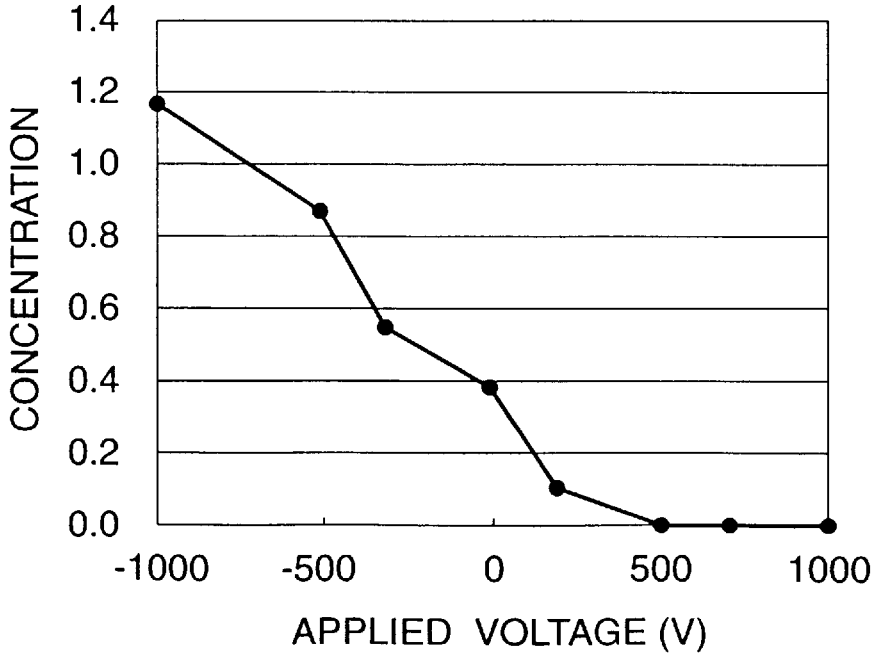
FIG. 20 is a graph showing experimental results using the sixth example of the invention.

Results are shown in FIG. 20.

It will thus be known that toner scatter can be prevented by applying a voltage of +500 V or greater to the driven roller 132.

It should be noted that our tests also demonstrated that toner scatter will not occur near the rollers when the voltage applied to driven roller 132, correction roller 133, and idler roller 136 is sloped from upstream to downstream by applying 650 V, 600 V, and 450 V, for example, to the respective rollers. This is because the voltage induced to the back of intermediate transfer belt 110 reduces gradually with distance from the first bias transfer roller 105*c* as described in the fourth example above.

As described above, charge elimination at the back of the intermediate transfer belt can be prevented in an image forming apparatus according to the present invention by providing a potential holding unit to the first member the intermediate transfer belt contacts after passing the first bias transfer unit, or to all members the intermediate transfer belt contacts between the first bias transfer unit and the second bias transfer unit. As a result, scattering of the toner image transferred to the intermediate transfer belt can be effectively prevented.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An image forming apparatus, having an image carrier on which a toner image is formed according to image data and held, an intermediate transfer belt disposed facing the image carrier and supported on a plurality of rollers with tension applied so as to move circularly, a first bias transfer unit for sequentially transferring a toner image on the image carrier to the intermediate transfer belt, and a second bias transfer unit for batch transferring the toner image on the intermediate transfer belt to a recording medium, comprising:

a first contact member that first contacts the intermediate transfer belt after the intermediate transfer belt passes the first bias transfer unit; and a potential holding unit, disposed to the first contact member, that holds the surface potential of the first contact member at the charge potential of the back of the intermediate transfer belt, wherein the potential holding unit disposes the first contact member ungrounded.

2. An image forming apparatus having an image carrier on which a toner image is formed according to image data and held, an intermediate transfer belt disposed facing the image carrier and supported on a plurality of rollers with tension applied so as to move circularly, a first bias transfer unit for sequentially transferring a toner image on the image carrier to the intermediate transfer belt, and a second bias transfer unit for batch transferring the toner image on the intermediate transfer belt to a recording medium, comprising:

a first contact member that first contacts the intermediate transfer belt after the intermediate transfer belt passes the first bias transfer unit; and a potential holding unit, disposed to the first contact member, that holds the surface potential of the first contact member at the charge potential of the back of the intermediate transfer belt, wherein the potential holding unit is a resistance grounding unit that grounds the first contact member through a high resistance resistor.

3. An image forming apparatus as described in claim 2, wherein the high resistance resistor is a coating layer formed on a surface of the first contact member.

4. An image forming apparatus as described in claim 3, wherein the coating layer is made from a PET resin or PFA resin.

5. An image forming apparatus, having an image carrier on which a toner image is formed according to image data and held, an intermediate transfer belt disposed facing the image carrier and supported on a plurality of rollers with tension applied so as to move circularly, a first bias transfer unit for sequentially transferring a toner image on the image carrier to the intermediate transfer belt, and a second bias transfer unit for batch transferring the toner image on the intermediate transfer belt to a recording medium, comprising:

a plurality of contact members that contact the intermediate transfer belt between the first bias transfer unit and the second bias transfer unit; and a potential holding unit, disposed to each of the plurality of contact members, that holds the surface potential of the contact member at the charge potential of the back of intermediate transfer belt, wherein the potential holding unit disposes each of the contact members ungrounded.

6. An image forming apparatus, having an image carrier on which a toner image is formed according to image data and held, an intermediate transfer belt disposed facing the image carrier and supported on a plurality of rollers with tension applied so as to move circularly, a first bias transfer unit for sequentially transferring a toner image on the image carrier to the intermediate transfer belt, and a second bias transfer unit for batch transferring the toner image on the intermediate transfer belt to a recording medium, comprising:

a plurality of contact members that contact the intermediate transfer belt between the first bias transfer unit and the second bias transfer unit; and a potential holding unit, disposed to each of the plurality of contact members, that holds the surface potential of the contact member at the charge potential of the back of intermediate transfer belt, wherein the potential holding unit is a resistance grounding unit that grounds each of the contact members through a high resistance resistor.

7. An image forming apparatus as described in claim 6, wherein the high resistance resistor is a coating layer formed on a surface of each of the contact members.

8. An image forming apparatus as described in claim 7, wherein the coating layer is made from a PET resin or PFA resin.

9. An image forming apparatus having an image carrier on which a toner image is formed according to image data and held, an intermediate transfer belt disposed facing the image carrier and supported on a plurality of rollers with tension applied so as to move circularly, a first bias transfer unit for sequentially transferring a toner image on the image carrier to the intermediate transfer belt, and a second bias transfer unit for batch transferring the toner image on the intermediate transfer belt to a recording medium, comprising:

a first contact member first contacted by the intermediate transfer belt after passing the first bias transfer unit; and a charge elimination preventing unit, disposed to the first contact member, that prevents elimination of the charge on the back of the intermediate transfer belt.

10. An image forming apparatus having an image carrier on which a toner image is formed according to image data and held, an intermediate transfer belt disposed facing the image carrier and supported on a plurality of rollers with tension applied so as to move circularly, a first bias transfer unit for sequentially transferring a toner image on the image carrier to the intermediate transfer belt, and a second bias transfer unit for batch transferring the toner image on the intermediate transfer belt to a recording medium, comprising:

a plurality of contact members contacted by the intermediate transfer belt between the first bias transfer unit and second bias transfer unit; and a charge elimination preventing unit, disposed to each of the plurality of contact members, that prevents elimination of the charge on the back of intermediate transfer belt.

* * * * *